United States Patent [19]

Gesche et al.

[11] Patent Number: 5,034,577

[45] Date of Patent: Jul. 23, 1991

[54] FLUID ACTUATED ELECTRICAL SWITCH

[75] Inventors: Roland Gesche, Seligenstadt; Stefan Locher, Alzenau, both of Fed. Rep. of Germany

[73] Assignee: Leybold Aktiengesellschaft, Hanau, Fed. Rep. of Germany

[21] Appl. No.: 398,708

[22] Filed: Aug. 25, 1989

[30] Foreign Application Priority Data

Jul. 15, 1989 [DE] Fed. Rep. of Germany ..... 3923474

[51] Int. Cl.[5] ..... H01H 35/38

[52] U.S. Cl. ..... 200/82 R; 91/466; 200/81 R; 200/81.4

[58] Field of Search ..... 60/473; 307/118; 340/611, 626; 91/466 X; 200/81 R X, 81.4 X, 81.5, 82 R X

[56] References Cited

U.S. PATENT DOCUMENTS 2,794,087 5/1957 Jennings et al. ..... 200/82
3,350,931 11/1967 Johnson ..... 73/701
3,941,957 3/1976 Tilman ..... 200/82 R
4,243,855 1/1981 Grutzmuller ..... 200/81 R
4,779,418 10/1988 Artzberger ..... 91/466

FOREIGN PATENT DOCUMENTS

De. 2624283 12/1976 Fed. Rep. of Germany .
DE 3341552 A1 5/1984 Fed. Rep. of Germany .
De 3421375 A1 12/1984 Fed. Rep. of Germany .
1317246 12/1961 France .
2082410 11/1971 France .

*Primary Examiner*—Gerald P. Tolin
*Attorney, Agent, or Firm*—Limbach, Limbach & Sutton

[57] ABSTRACT

The invention concerns an electrical reversing switch, which is especially suited for switching of high-frequency electrodes. This switch has an over mounted pneumatic cylinder, which moves on pistons arranged on both sides, and thus produces electric contacts.

9 Claims, 1 Drawing Sheet

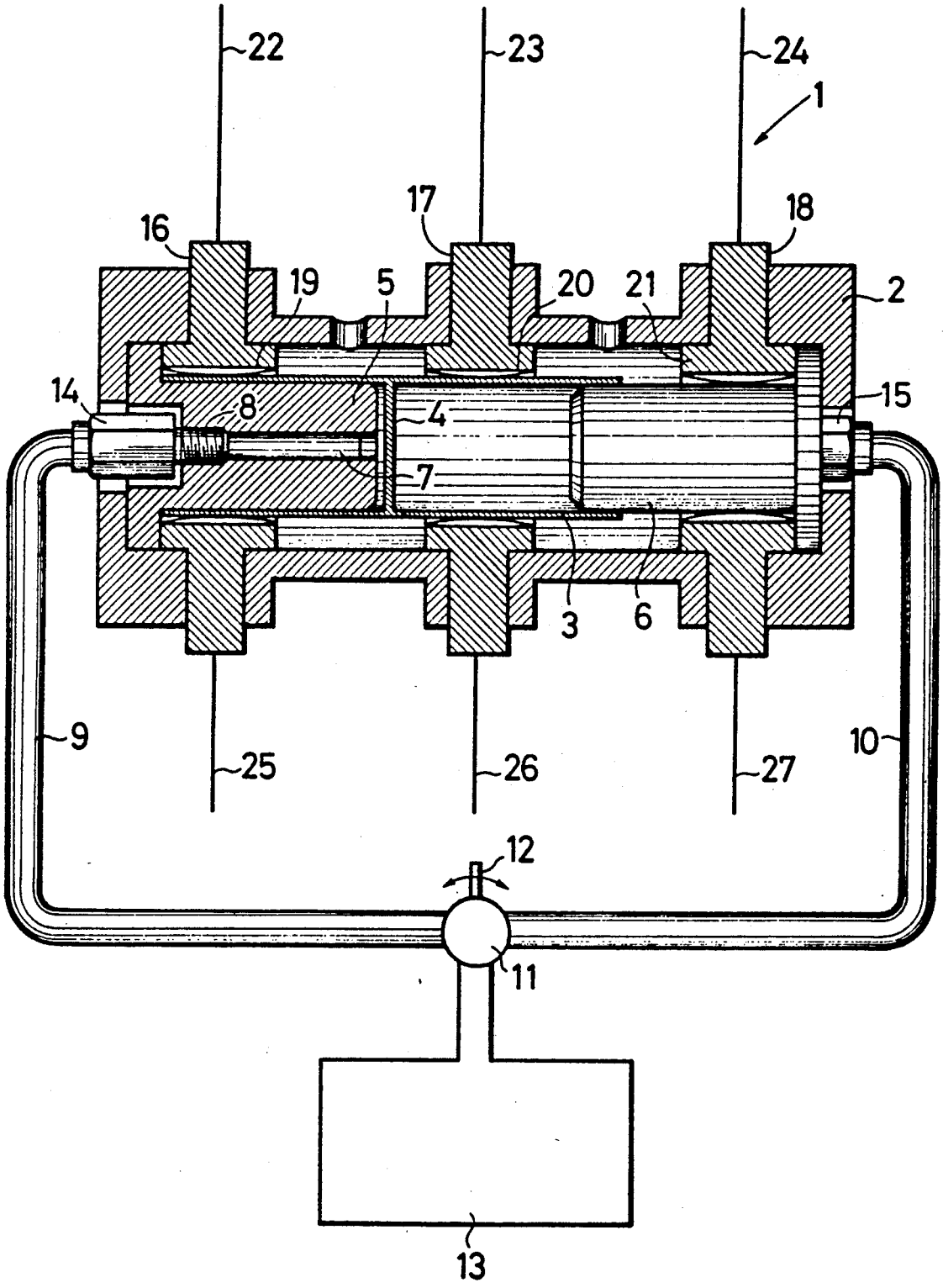
22
23
24
1
17
18
16
19
5
20
21
2
14
8
4
15
7
3
6
9
10
25
26
27
12
11
13

FLUID ACTUATED ELECTRICAL SWITCH

DESCRIPTION

The invention concerns an electrical reversing switch according to the specifications of patent claim 1.

Further applications have been found for plasma production in plants which deposit and strip thin films by using high frequency fields. The switches required for reversing the high frequency electrodes can transmit currents up to 50 A at typical frequencies of 13.56 MHz. These switches should be compact and have an open flash-over resistance of about 10 kV. The switch-over process is currentless.

The goal of the invention is to produce a switch of the above mentioned kind.

This problem is solved according to specifications of patent claim 1.

The particular advantage achieved by this invention is the large conducting surface which the surface current created by current displacement has at its disposal. In addition, the switch is self-locking, i.e. it is stable in every switch position. Compressed air is only required during the switching process, and the contacting surfaces clean themselves during switch-over.

A model example of this invention is depicted by the drawing and will be described in detail in the following.

The single figure shows a section through switch 1 according to the invention, which is made of a housing 2 composed of an insulating material, which contains a switching drum 3 with a mid-wall 4. This switching drum is supported on both sides by pilot cylinders 5, 6, of which one pilot cylinder, 5, is shown in cross section and the other pilot cylinder, 6, is drawn closed. In this example the pilot cylinders 5, 6 are solid and made of a synthetic material. Through each one of these cylinders passes one axial bore 7, going through an injection nozzle, 8, which is connected with its corresponding compressed air hose 9, 10. Both compressed air hoses 9, 10 are hooked up to a common pressure distributor 11, which is equipped with a mechanical reversing switch 12. A container with compressed air 13 is connected with the pressure distributor 11. The compressed air hoses 9, 10 have special injection nozzles 14, 15, which are fitted into the side wall of the housing 2. Fitted into the housing are also ring-shaped mountings 16, 17, 18, with multiple contact strips 19, 20, 21 on their inside-facing ends. When making an electric connection these contact strips lie against the outer wall of the switching drum 3. In the example shown both contact strips 19, 20 are in contact with the switching drum 3, while contact strip 21 is not. Thus, there exists an electric connection between the two strips 19, 20 and thus between the mountings 16, 17. If, for example, the mountings 16, 17, 18 are coupled with electric lines 22 thru 27, then, in the arrangement according to the figure, there is a connection between lines 22 and 23 or 25 and 26.

The invention makes it possible to change the electric connection depicted in the figure. To do this the compressed air lever 12 is swung to the right, such that the compressed air is supplied by hose 9 and bore 7 to the mid-wall 4. Due to the air pressure the switching drum then moves to the right guided by cylinders 5, 6. Once it arrives on the right side, it is no longer the contacting strips 19 and 20 but 20 and 21 which are electrically connected.

The switching drum 3 can be brough back to the position shown in the figure by swinging the lever 12 to the left. Thus, the switching drum moves like a free floating piston, for example, such as used in A.C. generators (DE-PS 26 24 283).

What is claimed is:

1. An improved fluid actuated electrical switch, comprising:

a housing (2) having opposing ends with piston means (5, 6) of electrically insulating material and an internal cavity with a cavity periphery and a longitudinal cavity axis;

connecting means (3) substantially contained within the housing cavity and having a fluid block, an at least partially conducting outer wall and a longitudinal axis which is substantially coaxial with the cavity axis;

at least three contacts (19, 20, 21) disposed about the periphery of the cavity of which at least two of the contacts (19, 20) can be placed in electric contact with the outer wall of the connecting means (3);

individual fluid supply arrangements (15, 10; 9, 14) coupled to the opposing ends of the connecting means (3); wherein the improvement is characterized in that:

the connecting means (3) is formed as a sleeve having an inner wall (4) as the fluid block, the wall (4) separating the sleeve into two cylinders;

the piston means (5, 6) having an outer diameter corresponding to the inner diameter of the respective cylinders;

the outer surface of the sleeve being substantially even and comprising an electrically conducting material; and the piston means (5, 6) having holes (7) for supplying a fluid.

2. A fluid actuated electrical switch, characterized by: a housing (2) having opposing ends and an internal cavity with a cavity periphery and a longitudinal cavity axis;

a reciprocative bistable drum (3) substantially contained within the housing cavity and having a fluid block (4), an at least partially electrically conducting outer wall, and a longitudinal drum axis which is substantially co-axial with the cavity axis, wherein the drum (3) is a hollow cylindrical shell with an internal wall (4) forming the fluid block, said drum (3) is guided by pilot cylinders (5, 6) which are received within the drum (3), and has stable positions as opposing ends of the housing cavity;

at least three contacts (19, 20, 21) disposed about the periphery of the cavity, of which at least two of the contacts (19, 20) can be placed in electric contact with the outer wall of the drum (3); and individual fluid supply arrangements (15, 10; 9, 14) coupled to the opposing ends of the drum (3).

3. An electrical switch according to claim 2 characterized in that the pilot cylinders (5, 6) have bores (7).

4. An electrical switch according to claim 2, characterized in that compressed air is used as the fluid.

5. An electrical switch according to claim 2, characterized in that the contacts (19, 20, 21) are multiple-contact strips.

6. An electrical switch according to claim 4, characterized in that the multiple-contact strips (19, 20, 21) are ring-shaped.

7. An electrical switch according to claim 2, characterized in that the contacts (19, 20, 21) are connected with mountings (16, 17, 18).

8. An electrical switch according to claim 2, characterized in that the housing (2) is made of an electrically nonconducting material, into which are embedded mountings (16, 17, 18) for the contacts (19, 20, 21).

9. An electrical switch according to claim 2, further characterized in that a switching mechanism (12), which can alternatively supply fluid to one end of the drum (3) and then to the other end, is coupled to the fluid supply arrangements (15, 10; 9, 14).

* * * * *